United States Patent [19]

Zeiler

[11] Patent Number: 4,717,863

[45] Date of Patent: Jan. 5, 1988

[54] FREQUENCY MODULATION BALLAST CIRCUIT

[76] Inventor: Kenneth T. Zeiler, 526 Park La., Richardson, Tex. 75081

[21] Appl. No.: 830,564

[22] Filed: Feb. 18, 1986

[51] Int. Cl.[4] ..... H05B 37/00

[52] U.S. Cl. ..... 315/307; 315/156; 315/158; 315/244; 315/DIG. 4

[58] Field of Search ..... 315/307, DIG. 4, 156, 315/158, 244

[56] References Cited

U.S. PATENT DOCUMENTS

| | | | |
|---|---|---|---|
| 1,922,984 | 8/1933 | Soundy | 315/244 |
| 3,449,629 | 6/1969 | Wigert et al. | 315/308 |
| 3,611,021 | 10/1971 | Wallace | 315/307 |
| 3,648,106 | 3/1972 | Engel | 315/307 |
| 3,681,654 | 8/1972 | Quinn | 315/151 |
| 3,710,177 | 1/1973 | Ward | 315/106 |
| 3,753,071 | 8/1973 | Engel | 315/20 |
| 3,875,459 | 4/1975 | Remery et al. | 315/205 |
| 4,053,813 | 10/1977 | Kornrumpf et al. | 315/206 |
| 4,060,751 | 11/1977 | Anderson | 315/209 R |
| 4,060,752 | 11/1977 | Walker | 315/244 |
| 4,117,377 | 9/1978 | Jimerson et al. | 315/209 R |
| 4,125,767 | 11/1978 | Silver | 250/214 D |
| 4,127,798 | 11/1978 | Anderson | 315/209 R |
| 4,170,747 | 10/1979 | Holmes | 315/307 |
| 4,188,660 | 2/1980 | Knoll | 363/49 |
| 4,251,752 | 2/1981 | Stolz | 315/206 |
| 4,277,728 | 7/1981 | Stevens | 315/307 |
| 4,346,332 | 8/1982 | Walden | 315/244 |
| 4,362,971 | 12/1982 | Sloan, Jr. | 315/176 |
| 4,370,600 | 1/1983 | Zansky | 315/244 |
| 4,441,053 | 4/1984 | Daspit | 315/206 |
| 4,471,269 | 9/1984 | Ganser et al. | 315/307 |
| 4,492,899 | 1/1985 | Martin | 315/308 |
| 4,498,031 | 2/1985 | Stupp et al. | 315/307 |
| 4,544,863 | 10/1985 | Hashimoto | 315/244 |

*Primary Examiner*—Harold Dixon

*Attorney, Agent, or Firm*—Richards, Harris, Medlock & Andrews

[57] ABSTRACT

A ballast circuit is provided for the start-up and operation of gaseous discharge lamps. A power transformer connected to an inductive/capacitive tank circuit drives the lamps from its secondary windings. An oscillator circuit generates a frequency modulated square wave output signal to vary the frequency of the power supplied to the tank circuit. A photodetector feedback circuit senses the light output of the lamps and regulates the frequency of the oscillator output signal. The feedback circuit also may provide input from a remote sensor or from an external computer controller. The feedback and oscillator circuits produce a high-frequency signal for lamp start-up and a lower, variable frequency signal for operating the lamps over a range of light intensity. The tank circuit is tuned to provide a sinusoidal signal to the lamps at its lowest operating frequency, which provides the greatest power to the lamps. The ballast circuit may provide a momentary low-frequency, high power cycle to heat the lamp electrodes just prior to lamp start-up. Power to the lamps for start-up and dimming is reduced by increasing the frequency to the tank circuit, thereby minimizing erosion of the lamp electrodes caused by high voltage.

24 Claims, 5 Drawing Figures

FREQUENCY MODULATION BALLAST CIRCUIT

TECHNICAL FIELD

The present invention relates to ballast circuits for gaseous discharge lamps and, in particular, to a ballast circuit utilizing frequency modulation to start and control the operation of fluorescent lamps while maximizing the life of the lamp electrodes.

BACKGROUND OF THE INVENTION

A fluorescent lamp is basically a glass tube filled with a gas, such as a combination of neon and a small amount of mercury vapor. The interior of the tube is coated with a phosphorus material and each end of the tube includes a filament cathode and an anode structure. In operation, each end of the tube is alternately the anode or the cathode during one half of the alternating current cycle.

When a high voltage, on the order of several hundred volts, is established between the two ends of the lamp, the gas within the tube becomes ionized and forms a conduction path, thereby producing an electric arc through the gas. After the gas is ionized and an arc is formed, the lamp has an extremely low electrical resistance. The electric current passing through the lamp produces energized molecules and electrons which strike the phosphorus material which then produces light that is emitted from the tube.

During operation of the lamp, the anode serves as the collector for charged ions. Heat is generated at the anode by the bombardment of arriving ions on the anode. The amount of heat generated by the arriving ions is determined by the relative anode voltage and the length of time the anode is positively charged. Thus, low frequency alternating current, such as standard 60 hertz, causes the anode to collect ions from a great distance because it is positively charged for a relatively long time. The ions accelerate toward the anode during the entire half cycle, and the ions farthest from the anode arrive at relatively high velocities, imparting significant mechanical energy to the anode. The energy of ion bombardment causes heating and erosion of the anode. The erosion of the anode is a major factor affecting the lifetime of the lamp and a major limitation to the maximum light intensity that can be obtained from a given fluorescent lamp.

The power and the lifetime of a fluorescent lamp are affected by the frequency of the alternating current and the shape, or "crest factor", of the alternating current waveform. In any given waveform there is a peak voltage and an average voltage. Although a certain minimum voltage is necessary to operate a fluorescent lamp, the ideal waveform is a square wave, which has the lowest ratio of peak to average voltage, or the lowest crest factor. The square wave produces the highest average current with the least amount of anode erosion caused by high peak voltage. Other waveforms can provide the same average current, but with an undesirable high peak voltage that produces a current pulse during the cycle. During the current pulse, ions arrive at the anode with greater energy, causing rapid erosion of the electrodes and limiting power and efficiency of the lamp.

Prior art ballast circuits have not been designed to maximize the lifetime of fluorescent lamp electrodes in operations involving either low power dimming or high light intensity. Prior ballast circuits generally provide an undesirable distribution of output energy with respect to time, either in the waveform shape, the time intervals between voltage pulses, or both. Ballast circuits which provide for lamp dimming by increasing the time period between high power voltage pulses cause disproportionate anode erosion in relation to the low light intensity produced. Ballast circuits which provide for lamp dimming by changing the waveform shape of a fixed frequency alternating current produce a high crest factor which causes disproportionate electrode erosion during the high power pulse, thereby limiting the life of the lamp and the usable dimming range.

In general, prior art ballast circuits do not provide for optimum lamp life in either dimming operations or high intensity operations. Therefore, there is a need for a fluorescent lamp ballast circuit which provides extended lamp lifetime by minimizing electrode erosion during lamp start-up, dimming operations, and high intensity operations.

SUMMARY OF THE INVENTION

The ballast circuit of the present invention utilizes frequency modulation for starting and operating fluorescent lamps while maximizing the lifetime of the lamp electrodes. Frequency modulation allows both dimming operations and high intensity operations without causing disproportionate erosion of the anodes due to ion bombardment. The development of high intensity fluorescent lamps having a long lifetime makes it practical to use flourescent lamps as the source of light for high speed optical scanning devices.

The ballast circuit of the present invention utilizes a half-bridge output circuit to drive an inductor/capacitor (LC) tank circuit tuned to the minimum operating frequency of the lamp. The lamp driver circuit produces a sinusoidal waveform at the lowest operating frequency, which is the condition of maximum current flow to the lamp due to the inductance of the choke. An oscillator circuit provides a frequency modulated square wave output to modulate the frequency of the driver power to control the light output of the lamp. For example, at maximum power the lamp may operate at about 50 kHz, and at minimum power the lamp might operate at 200 kHz, holding the lamp to ¼ of the maximum power.

Fluorescent lamps start easier at higher frequencies. The ballast circuit of the present invention switches to its highest frequency to start the lamp and switches to a lower operating frequency after the lamp has started. Thus, the present invention allows a lower voltage start-up that minimizes erosion of the electrodes, eases the power surge in the circuit, and improves the reliability of the power supply.

Another aspect of the ballast circuit of the present invention is a photodetector feedback loop which includes a photoresistor to monitor the light output of the lamp. The photoresistor circuit is coupled to the oscillator circuit to provide feedback for automatic starting and direct control of the lamp and to compensate for decay of the lamp with age. The circuit may also include a second sensor to respond to commands, events, or ambient conditions in a remote location. In addition, the control circuit will accept an analog voltage signal from a computer to set the light level, which can be detected and maintained by the photoresistor feedback loop.

When the photoresistor detects that there is no light output from the flourescent lamp, the drive circuit switches to the start-up mode. During start-up, there may be a short time delay during which low frequency, high current power is provided to quickly heat the lamp electrodes. Following this short delay, the driver circuit automatically switches to the high frequency, low voltage start-up signal to establish the arc across the lamp.

The ballast circuit may include an idle mode which, when activated, drives the fluorescent lamp to the high frequency, minimum power level. The idle mode allows the lamp to remain activated at a very low power level and permits it to be driven quickly to the maximum power level.

The present invention also allows the use of two to three times greater power than is used in a conventional fluorescent lamp without causing excessive erosion of the electrodes. Such high intensity fluorescent lamps may be used in high speed optical scanning operations. In the past, high speed optical scanning utilized tungsten lights for illumination. However, tungsten lights produce intense heat which can ignite or damage the articles being scanned if they stop or become jammed under the light. The use of fluorescent lamps with the ballast circuit of the present invention provides sufficient high intensity light for high speed optical scanners without the generation of excessive heat.

The present invention is applicable to any type of gas discharge lamps including fluorescent and mercury vapor lamps.

BRIEF DESCRIPTION OF THE DRAWINGS

For a more complete understanding of the present invention and for further advantages thereof, reference is now made to the following Description of the Preferred Embodiments taken in conjunction with the accompanying Drawings, in which.

DESCRIPTION OF THE PREFERRED EMBODIMENTS

Figure 1:
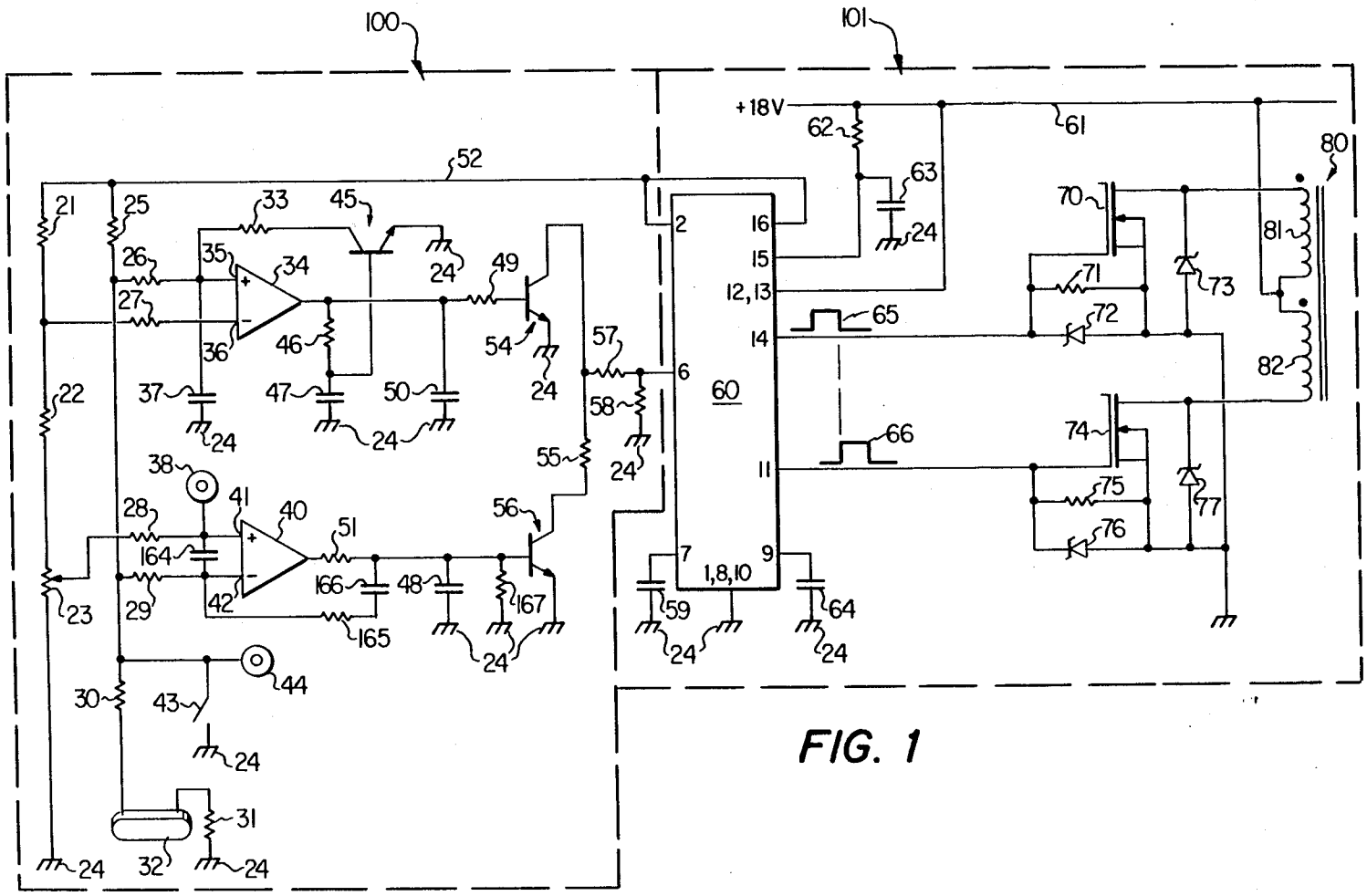
FIG. 1 is a schematic diagram of the oscillator/detector circuit of the present invention.

FIG. 1 is a schematic illustration of a photodetector feedback circuit 100 connected to an oscillator circuit 101. Reference numeral 60 indicates an integrated circuit power supply control chip that has been configured to operate with a constant full pulse width and to modulate only the operating frequency of its output. For example, chip 60 may comprise a UC3524A integrated circuit chip which is manufactured by Unitrode. The reference numerals within the block representing the chip 60 indicate the various terminal pins of the chip.

The multifunction control chip 60 performs the following functions: (a) Chip 60 provides a 5-volt precision reference at pin 16 that is used to power a line 52 and to provide reference voltages in the serially connected string of resistors 21, 22, and 23; (b) Chip 60 incorporates an oscillator, the frequency of which is determined by a capacitor 59 connected to pin 7 and by the current drain at pin 6 provided by the detector circuit 100; and (c) Chip 60 provides frequency modulated square wave output waveforms 65 and 66 at pins 11 and 14 which are 180° out of phase with each other.

Power from an 18-volt bus 61 is fed directly to pins 12 and 13 of chip 60 to provide full potential for the square wave output circuitry. Reference numeral 24, which is used throughout the FIGURES, indicates a common 18-volt return bus. Pin 15 is the power input terminal for the internal logic circuitry of chip 60. The input voltage to pin 15 is conditioned by resistor 62 and capacitor 63, which insulate pin 15 from bus noise generated by the square wave output circuit. A 5-volt reference from pin 16 is applied to pin 2 to disable the pulse width modulation function and to obtain maximum pulse width for full duty cycles at all times. Pin 16 is further connected to a line 52. The input signals to chip 60 consist of those from capacitor 59 attached between pin 7 and return bus 24 and those from the current drain of the detector circuit 100 attached to pin 6. The value of the current drain, or cumulative resistance of the detector circuit 100, determines the output frequency of chip 60 at pins 11 and 14, the lower the resistance at pin 6, the higher the frequency of the output. Capacitor 64, which is connected between pin 9 and return bus 24, buffers the error output circuitry of chip 60 so that the response of chip 60 to frequency changes is not erratic.

Figure 2:
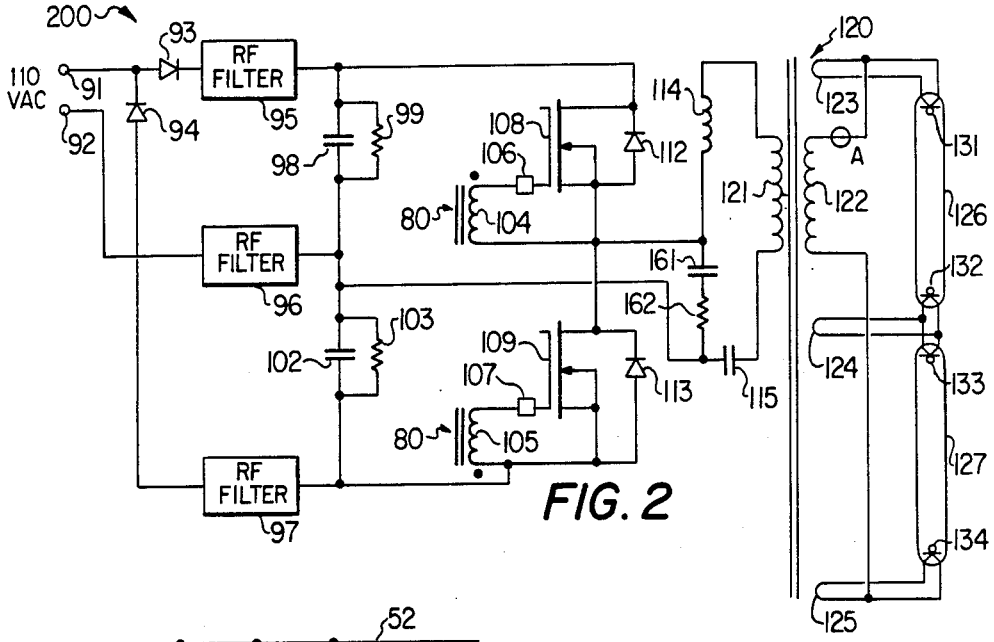
FIG. 2 is a schematic diagram of the power output circuit of the present invention.

In the detector circuit 100 of FIG. 1, a photoresistor 32 is positioned to detect the light output of fluorescent lamps 126 and 127, which are shown in FIG. 2. The resistance of photoresistor 32 varies from less than one hundred ohms to several megohms. The string of resistors 21, 22, and 23 is fed from the 5-volt reference pin 16 of chip 60 through line 52. The junctions between resistors 21, 22, and 23 provide reference voltages at the inverting input 36 of an operational amplifier 34 and at the non-inverting input 41 of an operational amplifier 40. The values of the resistors 21, 22, and 23 are determined by the power levels necessary for the flourescent lamps to start and operate. Operational amplifier 34 controls the lamp starting conditions and operational amplifier 40 controls the lamp operating conditions. Resistors 26, 27, 28, and 29 are input resistors to operational amplifiers 34 and 40. A second set of resistors 25, 30, and 31 are serially connected with photoresistor 32 to provide voltage control for photoresistor 32. Resistor 25 limits the photoresistor current to safe levels. Resistors 30 and 31 serve to isolate the detector circuit 100 from any noise generated by the circuit link to photoresistor 32.

When the fluorescent lamps 126 and 127 are operating at usable light levels, the photoresistor 32 presents a resistance of approximately 50 to 5000 ohms. With the photoresistor 32 in this condition, the voltage at non-inverting input 35 is lower than the voltage at inverting input 36, which causes operational amplifier 34 to have a low output to buffer resistor 49 and capacitor 50, thereby turning off transistor 54. Thus, the lamp starting circuit, comprising operational amplifier 34 and transistor 54, is held inactive by providing a high impedance to pin 6.

The operational amplifier 40 is configured as a voltage comparator and acts to minimize any voltage differential between non-inverting input 41 and inverting input 42. The voltage at input 41, which determines the light level of the fluorescent lamps 126 and 127, is adjusted by the wiper setting of the variable resistor 23. The circuit comprising operational amplifier 40, buffer resistors 51 and 167, capacitors 48 and 164, an RC network consisting of resistor 165 and capacitor 166, a transistor 56, and photoresistor 32 functions as part of a feedback circuit to control the intensity of the light output produced by fluorescent lamps 126 and 127. For example, if the voltage at input 42, which is determined by the photoresistor 32, is less than the reference voltage at input 41, which indicates that the lamp intensity is greater than that selected by the wiper at variable resistor 23, the output of operational amplifier 40 will increase, thereby turning on transistor 56 to a degree dependent on the voltage differential between inputs 41 and 42. As a result, the current flow from pin 6 of chip 60 will increase, thereby raising the output frequency of chip 60 as explained above.

Resistor 58 establishes the minimum operating frequency of the chip 60, which in this embodiment is 55 kHz. With transistor 56 switched on fully, the current drain from pin 6 through resistors 55 and 57 increases to drive the chip 60 to its maximum operating frequency, which in this embodiment is approximately 155 kHz. Thus, if lamp brightness increases, the resistance of photoresistor 32 decreases, lowering the voltage level at input 42 and raising the output of operational amplifier 40, which in turn increases the current from pin 6 through transistor 56. This action causes the output frequency of chip 60 to increase, which reduces the current to the fluorescent lamps 126 and 127, as described below, and returns the light level to equilibrium. The detector circuit 100 of this invention is capable of regulating the light intensity of the lamps to within ±1% of the selected level.

When the fluorescent lamps 126 and 127 are off and the photoresistor 32 is dark, the resistance of the photoresistor 32 is very high compared to the other resistors in the circuit. In this state, the voltage at input 35 is higher than the voltage at input 36, which causes operational amplifier 34 to have a high output. The high output from operational amplifier 34 turns on transistor 54 which effectively shorts out transistor 56 and resistor 55 and drives the chip 60 to its highest frequency, which is now determined only by resistors 57 and 58. This start-up frequency, greater than 350 kHz, is higher than the normal steady state operating frequencies for the lamps. However, when the lamps start and illuminate photoresistor 32, the resistance of photoresistor 32 drops significantly and brings the voltage at input 35 to below that of input 36, thereby turning off operational amplifier 34 and transistor 54 and returning control to operational amplifier 40.

The function of operational amplifier 34 is modified by capacitor 37 to enhance electrode heating during the lamp starting cycle. Capacitor 37 is in a discharged state prior to initiation of the start-up cycle. When the start-up cycle is initiated, capacitor 37 begins to charge, which momentarily holds the voltage at input 35 at a low level. This action delays the turn-on of operational amplifier 34 so that operational amplifier 40 will operate the lamp drive circuit 200 of FIG. 2 at a low frequency and provide extra current to heat lamp electrodes 131, 132, 133, and 134, shown in FIG. 2, prior to the start-up attempt. When capacitor 37 is completely charged, operational amplifier 34 and transistor 54 turn on and activate the high frequency starting conditions. When the lamps start, control of lamp operation returns to operational amplifier 40 as explained above.

If the lamps fail to start on the first attempt, the high output of operational amplifier 34 will charge capacitor 47 through resistor 46 and turn on transistor 45, which will discharge capacitor 37 through resistor 33. As a result, the low frequency electrode warming cycle will be resumed until capacitor 37 is once again fully charged and operational amplifier 34 and transistor 54 are again turned on to reactivate the starting frequency. This sequence will be repeated until the lamps start successfully.

The circuit of FIG. 1 also has provisions for an external override of the operating conditions. An idle condition can be caused by closing switch 43 or by applying a ground state to jack 44. In either of these conditions, the output of operational amplifier 40 will go high and increase the oscillator frequency of chip 60 to its highest operating frequency, thereby minimizing power output to the lamps. Jack 44 may be used, for example, to idle the lamps between demand periods, to sense external events, or to permit computer control of light exposure times.

Jack 38 is provided to receive an external voltage signal to impose a remotely controlled level of light intensity. The remotely controlled light level could be in response to ambient lighting conditions, a remote event, or an external computer control signal. An example of an ambient light circuit connected at jack 38 is illustrated and described below in conjunction with FIG. 3.

As shown in FIG. 1, oscillator chip 60 provides square wave outputs 65 and 66 at pins 11 and 14. When the output at pins 14 goes high, a field effect transistor 70 switches on and applies current to a winding 81 of a transformer 80. Zener diode 72 ensures that the voltage applied to the gate of transistor 70 does not exceed 20 volts. When the voltage at pin 14 goes to zero, resistor 71 functions to discharge the gate of transistor 70, thereby turning off transistor 70. Zener diode 73 ensures that the voltage across transistor 70 does not exceed its maximum rating.

A short period of dead time will occur after the voltage on pin 14 goes low and before the voltage on pin 11 goes high. When the voltage on pin 11 goes high, a transistor 74 switches on and applies current through a winding 82 of transformer 80. The primary windings 81 and 82 of transformer 80 are configured so that the decay of winding 81, as transformer 70 is switched off, adds to the total primary transformer current. The function of the circuit components 75, 76, and 77 associated with transistor 74 are identical to those associated with transistor 70 and described above. Further, it is anticipated that more specialized integrated circuits can be used to replace chip 60 and provide the power to drive transformer 80 directly so as to eliminate the need for transistors 70 and 74.

The power output circuit 200 of the present invention is illustrated in FIG. 2. Secondary windings 104 and 105 of transformer 80 are configured such that the power output of each winding is 180° out of phase with the other. As a result, a transistor 108, a high voltage field effect transistor, switches on when a similar transistor 109 switches off, and transistor 109 switches on when transistor 108 switches off. The waveforms applied at the gates of transistors 108 and 109 are square in shape, thereby optimizing the efficiency of transistors 108 and 109.

Ferrite beads 106 and 107 suppress voltage spikes and ringing conditions on the gate leads of transistors 108 and 109, respectively. Diodes 112 and 113 act to protect transistors 108 and 109, respectively, from high inverse voltages. Capacitor 161 and resistor 162 act to suppress radio frequency noise on the output circuit generated by the dead time between switching of transistors 108 and 109.

Three RF filters 95, 96, and 97 remove radio frequency interference from the input power lines 91 and 92 and protect transistors 108 and 109 from voltage transients. Diodes 93 and 94 function with capacitors 98 and 102 to provide a voltage doubler and direct current source, with resistors 99 and 103 acting as bleeder resistors. With 110 volts AC at input lines 91 and 92, 155 volts DC is present across each of the capacitors 98 and 102.

When transistors 108 switches on due to positive voltage on its gate, current is drawn from the capacitor 98, upward through a primary winding 121 of a transformer 120, through an inductor 114 and transistor 108, and returned to the capacitor 98, thereby charging capacitor 115 so that the terminal of capacitor 115 joining transformer 120 is positively charged.

When the voltage across the transformer 80 reverses, transistor 108 switches off and transistor 109 switches on. In this phase of operation, current is drawn from the capacitor 102, through transistor 109 and inductor 114, and downward through winding 121 of transformer 120, thereby reversing the charge of capacitor 115 so that the terminal of capacitor 115 joining transformer 120 is negatively charged.

Inductor 114 is connected at the common output of the two power transistors 108 and 109. Inductor 114 and capacitor 115 are selected so that at the lowest operating frequency, which provides the highest power to the lamps 126 and 127, the waveform produced by transistors 108 and 109 is a sinusoid. This waveform provides the maximum power with the lowest ratio of peak voltage to average voltage, thereby minimizing erosion of the lamp anodes.

During operation of lamps 126 and 127, control of starting and intensity is provided by the frequency modulated output of chip 60. As the operating frequency increases, the reactance of inductor 114 also increases, thereby reducing the amount of current passing through the primary winding 121 of transformer 120 and reducing the power provided to lamps 126 and 127. Therefore, as the operating frequency of the driver circuit 200 increases, the amount of power transferred to the fluorescent lamps 126 and 127 decreases.

Although two fluorescent lamps are shown in FIG. 2, the circuit 200 could also be used to drive a single lamp or any other type of gas discharge lamp, such as a mercury vapor lamp.

Inductor 114, capacitor 115, and transformer 120 comprise an inductive/capacitive tank circuit which is resonant at a certain frequency and which uses capacitors 98 and 102 as alternate power sources in a half-bridge fashion. The operation of the present invention, however, is not limited to the use of a half-bridge output circuit since any series output circuit capable of being driven at variable frequencies would be functional according to the principles of the invention.

The actual electrical ratings of inductor 114, capacitor 115, and transformer 120 are selected to match the lamp driver circuit 200 to the specific type of lamp being used and to the relative power levels required. The reactance of inductor 114 is selected to pass a desired amount of current at the lowest operating frequency. The reactance of capacitor 115 is selected to provide a sinusoidal waveform at or near the lowest operating frequency. The primary and secondary windings of transformer 120 are configured to properly drive the selected lamps in the desired power range. The secondary windings 123, 124, and 125 of transformer 120 are utilized to heat the electrodes 131, 132, 133, and 134 of lamps 126 and 127.

Figure 3:
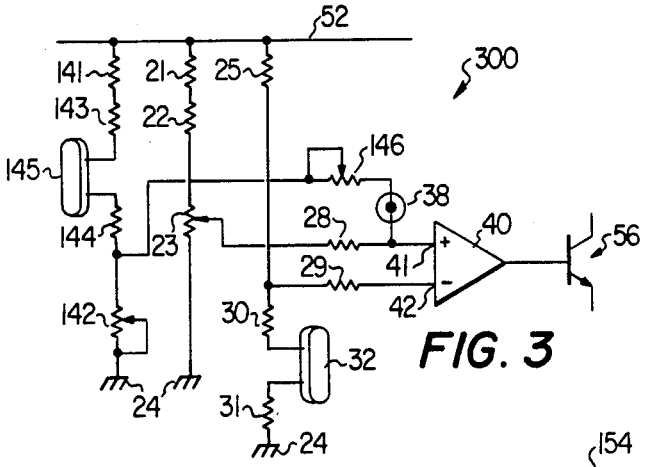
FIG. 3 is a schematic diagram of an optional detector circuit of the present invention showing a remote light sensor.

FIG. 3 illustrates an optional detector circuit 300 which may be connected to jack 38. A resistor 141 serves to limit the maximum current available to a remote photoresistor 145. Resistors 143 and 144 serve to isolate the circuit 300 from any noise generated by the components associated with photoresistor 145. A variable resistor 142 establishes the light level setting desired at the remote photoresistor 145. The voltage established at resistor 142 is combined with the voltage established at resistor 23 to determine the actual voltage applied at input 41, which determines the light level setting. The resistor 146 can be varied to establish the relative response of the system to light level changes at the remote photoresistor 145. For example, a large value of resistor 146 would require a greater excursion of the light level at photoresistor 145 to change the output of operational amplifier 40.

Figure 4:
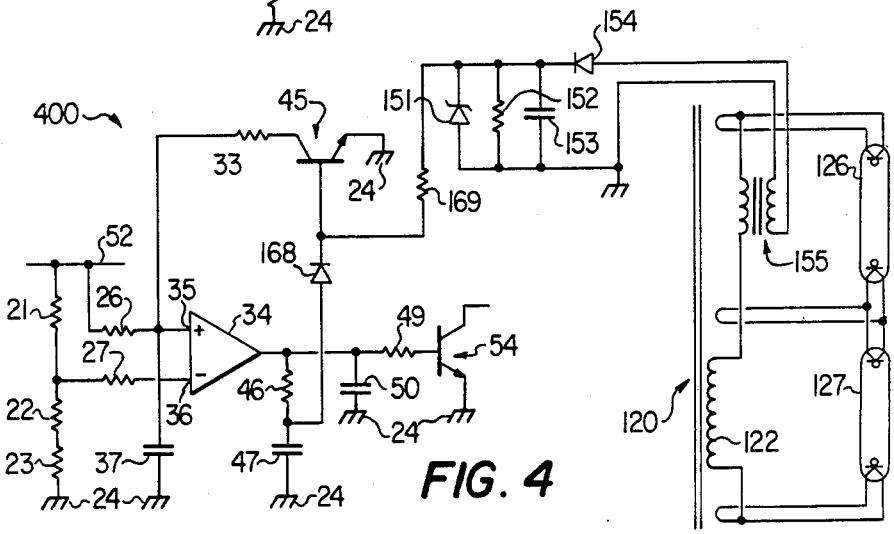
FIG. 4 is a schematic diagram of an alternate circuit for detecting the illumination status of the lamps.

FIG. 4 illustrates a current sensing circuit 400 for determining the operational status of lamps 126 and 127. Circuit 400 is a variation of the power output circuit 200 shown in FIG. 2 together with a portion of the oscillator/detector circuit 100 shown in FIG. 1, wherein like reference numerals identify similar circuit elements. In this alternate circuit 400, input 35 of amplifier 34 is connected to the reference voltage at line 52 through resistor 26. This connection tends to hold input 35 high with respect to input 36, which simulates the voltage relationship between inputs 35 and 36 when the lamp detector photoresistor 32 of FIG. 1 is dark.

FIG. 4 also illustrates the addition of a diode 168 in the base circuit of transistor 45. The addition of this diode does not affect the starting cycle sequence described in reference to FIG. 1. A resistor 169 serves to isolate the lamp current sensing circuitry from the base circuit of transistor 45 until the lamps are started. The starting cycle sequence described in reference to FIG. 1 performs in the same manner for circuit 400. In circuit 400, the output of operational amplifier 34 is determined by the level of current detected flowing through lamps 126 and 127. A current sensing transformer 155 is inserted in the circuit 200 of FIG. 2 at point A in series with the high voltage secondary winding 122 of transformer 120. When lamps 126 and 127 are not ignited, a capacitor 153 is discharged by a resistor 152, such that the operation of transistor 45 and operational amplifier 34 is not affected. As a result, the high frequency starting signal is supplied as described above. The cyclic starting attempts also described above in reference to FIG. 1 remain the same.

When lamps 126 and 127 are started, capacitor 153 is charged through diode 154. Zener diode 151 functions to limit the maximum voltage during current transients and a resistor 152 functions to discharge capacitor 153 when the lamp driver circuit of the present invention is turned off. When capacitor 153 is charged to a minimum voltage level necessary to turn on transistor 45 through resistor 169, input 35 is forced low and the output of operational amplifier 34 is turned off, thereby turning off transistor 54 and transferring control to operational amplifier 40 as described above. Diode 168 serves to isolate the low output of amplifier 34 from the elevated base of transistor 45.

Figure 5:
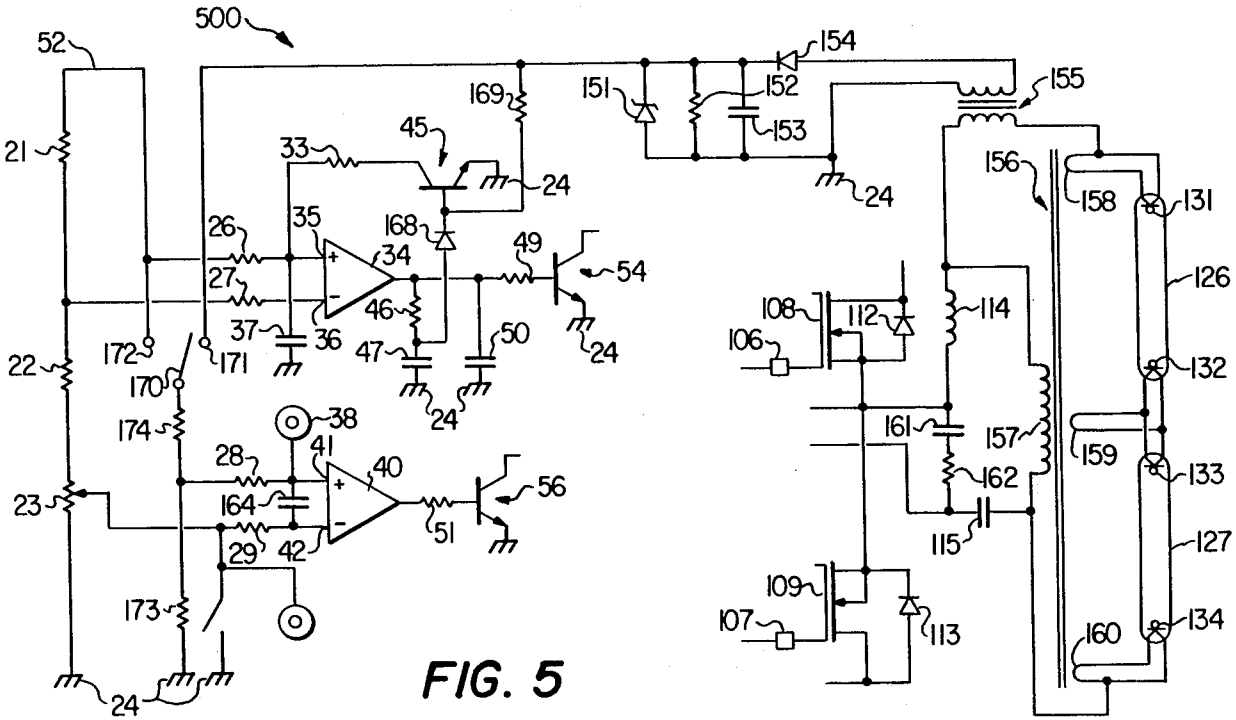
FIG. 5 is a schematic diagram of an alternate power output circuit utilizing direct lamp coupling.

An economical version of the present invention utilizing a direct coupled output to the lamps is illustrated as circuit 500 in FIG. 5. In its basic configuration the circuit achieves high frequency starting, idle, and current control without light detectors, such as photoresistor 32. The degree of light regulation can be changed if lamp temperatures change. However, ballast circuit jacks 38 and 44 and switches 43 and 172 permit precision external regulation if needed.

A direct coupled power output configuration is illustrated in FIG. 5 for circuit 500. The function of the circuit 500 is identical to the power output circuit 200 illustrated in FIG. 2. The output power transformer 120 has been removed and the tank circuit inductor 114 and capacitor 115 are coupled directly to the electrodes 131 of lamp 126 and 134 of lamp 127 respectively.

Transformer 156 serves only as a filament transformer with winding 157 as a primary winding. Output windings 158, 159 and 160 are equivalent in function to the windings 123, 124 and 125 of the transformer 120 shown in FIG. 2.

The radio frequency snubber network comprising resistor 162 and capacitor 161 remains the same for both output configurations.

Transformer 155 and the associated circuitry consisting of diode 154, capacitor 153, resistor 152 and zener diode 151 function as described in reference to FIG. 4. The operation of operational amplifier 34 is the same as that described in reference to FIG. 4. However, the output of transformer 155 is now used both to start the lamps 126 and 127 and to regulate the lamps when switch 170 is closed to position 171. When switch 170 is closed to position 171 and the power transistors 108 and 109 are alternately switched on, transformer 156 provides filament power, but no current will flow through current transformer 155. A resistor 173 holds operational amplifier input 41 low. The reference voltage at line 52 holds inputs 35 and 42 high respectively. Operational amplifier 40 then has a low output, thereby providing the lowest frequency power to warm the filaments of the lamps 126 and 127. Operational amplifier 34 will be held low momentarily due to the charging of capacitor 37. When capacitor 37 charges, amplifier 34 will generate a high output, initiating the starting cycle as described in FIG. 1.

When the lamps strike, current flows from return bus 24 through resistors 173 and 174 to transformer 155. Current drawn from the base of transistor 45 through resistor 169 turns on transistor 45 which pulls down input 35 of amplifier 34, turning off transistor 54, thereby stopping the start sequence and yielding control to amplifier 40. If the voltage at input 41 of amplifier 40 climbs above that of input 42, indicating high lamp current, amplifier 40 increases its output, turning on transistor 56 which will increase the lamp driver frequency at the output of transistors 108 and 109 and reduce the lamp current until inputs 41 and 42 are at equilibrium. The actual lamp current level is adjusted by the voltage at the wiper of resistor 23. This configuration provides lamp regulation based on lamp current alone. Jack 44 and switch 43 can be used to force an idle condition by grounding input 42 of amplifier 40. With input 42 at ground and input 41 at some operational level, amplifier 40 increases its output, turning transistor 56 on and driving the lamp driver transistors 108 and 109 to maximum operating frequency, until the ground condition is removed.

Jack 38 is not effective with switch 170 in position 171.

When switch 170 is in position 172, transformer 155 is used only to determine lamp ignition status as is shown in FIG. 4. The precision voltage at line 52 provides a reference voltage to input 41 of amplifier 40 through the series of resistors 173 and 174. The voltage applied to input 41 is sufficiently positive to exceed any voltage available at the wiper of resistor 23. With input 41 held higher than input 42, amplifier 40 has a high output, turning on transistor 56 and driving the lamp driver circuit of the present invention to its highest frequency or idle condition.

When switch 170 is in position 172, the lamp driver circuit of the present invention will remain in the idle condition until reduced voltages are applied to jack 38. This can be accomplished by any method including those previously identified above. The precision of regulation is determined by the voltage at jack 38. The remote detector circuit 300 illustrated in FIG. 3, for example, will function in this configuration.

Although the present invention has been described with respect to specific preferred embodiments thereof, various changes and modifications may be suggested to one skilled in the art, and it is intended that the present invention encompass such changes and modifications as fall within the scope of the appended claims.

I claim:

1. A ballast circuit for a gas discharge lamp, comprising:

a direct current power source;

means for producing a variable frequency control signal;

means responsive to said control signal for producing a switched output from said direct current power source, said switched output having a frequency proportional to said control signal;

an inductor connected to provide said switched output to drive said lamp wherein greater power is applied to said lamp when the frequency of said control signal is decreased and less power is supplied to said lamp when the frequency of said control signal is increased; and means for detecting when said lamp is not producing light for driving said control signal to a predetermined high frequency state to provide starting power for said lamp.

2. A ballast circuit as recited in claim 1 including a transformer connected to transfer power from said inductor to said lamp.

3. A ballast circuit as recited in claim 1, including a capacitor connected in series with said inductor and said lamp wherein said inductor and said capacitor convert said switched output into a sinusoid at said lamp at a predetermined frequency of said control signal.

4. A ballast circuit as recited in claim 1, including means for detecting the intensity of light produced from said lamp for varying the frequency of said control signal to regulate the intensity of light produced by said lamp.

5. A ballast circuit as recited in claim 1, wherein said means for producing a variable frequency control signal comprises:

means for regulating said control signal to provide high-frequency power for starting the lamp and variable low-frequency power for operating the lamp to produce variable light intensity, and said means for regulating including a feedback circuit responsive to light from the lamp, said feedback circuit providing signals to said control signal producing means for modulating the frequency of said control signal, thereby regulating the light intensity of the lamp.

6. A ballast circuit for a gas discharge lamp, comprising:

a direct current power source;

oscillator means for producing a frequency modulated control signal;

driver means responsive to said control signal and connected to receive power from said pwoer soruce for producing output power having an amplitude related to the frequency of said control signal, said variable amplitude output power provided to drive said lamp, said driver means including a power transformer having primary and secondary windings, said secondary windings connected in series with the lamp; and said driver means including an inductor and a capacitor connected in series with said primary winding to form an inductive/capacitive tank circuit, said tank circuit tuned to provide a sinusoidal waveform at approximately the minumum operating frequency of the ballast circuit.

7. A ballast circuit for a gas discharge lamp as recited in claim 6 including:

means for regulating said oscillator control signal to provide high-frequency power from said driver means for starting the lamp and variable low-frequency power from said driver means for operating the lamp to produce variable light intensity.

8. The ballast circuit of claim 6, wherein said driver means further comprises transistor means for providing power from said power source to said tank circuit, said transistor means responsive to said control signal from said oscillator means.

9. The ballast circuit of claim 6, wherein said oscillator means comprises a power control integrated circuit having a frequency modulated square wave output.

10. The ballast circuit of claim 9, wherein said oscillator means further comprises transformer means for transferring said square wave output to said driver means.

11. The ballast circuit of claim 7, wherein said means for regulating comprises a feedback circuit responsive to light from the lamp, said feedback circuit providing signals to said oscillator means for modulating the frequency of said control signal, thereby regulating the light intensity of the lamp.

12. The ballast circuit of claim 11, wherein said feedback circuit includes a photoresistor.

13. The ballast circuit of claim 12, wherein said means for regulating further comprises:

a first operational amplifier connected between said photoresistor and said oscillator means for controlling the lamp starting conditions;

a second operational amplifier connected between said photoresistor and oscillator means for controlling the lamp operating conditions; and means for switching said first amplifier on and said second amplifier off when the lamp is being started, and for switching said first amplifier off and said second amplifier on when the lamp is operating.

14. The ballast circuit of claim 13, wherein said means for regulating further comprises means for initiating a lamp electrode heating cycle just prior to lamp start-up.

15. The ballast circuit of claim 14, wherein said means for regulating further comprises means for reinitiating said electrode heating cycle if the lamp fails to start.

16. The ballast circuit of claim 12, wherein said feedback circuit further comprises a second photoresistor remotely located from the lamp.

17. The ballast circuit of claim 7, wherein said means for regulating includes means for selecting an idle mode, wherein the lamp is operated in a high-frequency, low-power standby mode.

18. The ballast circuit of claim 7, wherein said means for regulating includes an input jack for receiving lamp control signals from an external source.

19. The ballast circuit of claim 18, wherein said external source comprises computer generated control signals.

20. A ballast circuit for a gas discharge lamp, comprising:

a direct current power source;

a power transformer having primary and secondary windings, said secondary winding connected in series with the lamp;

an inductor and a capacitor connected in series with said primary winding to form an inductive/capacitive tank circuit, said tank circuit tuned to provide a sinusoidal waveform at approximately a minimum operating frequency of the ballast circuit;

an oscillator for providing a frequency modulated output;

a power transistor responsive to said oscillator output, said transistor providing power from said power source to said tank circuit for driving said lamp; and a feedback circuit comprising a photoresistor responsive to light from the lamp, said feedback circuit providing signals to said oscillator for regulating the frequency of said modulated output.

21. The ballast circuit of claim 20, wherein said feedback circuit further comprises:

a first operational amplifier connected between said photoresistor and said oscillator for controlling the lamp starting conditions;

a second operational amplifier connected between said photoresistor and said oscillator for controlling the lamp operating conditions; and transistor means for switching said first amplifier on and said second amplifier off during lamp start-up, and for switching said first amplifier off and said second amplifier on during lamp operation.

22. The ballast circuit of claim 20, wherein said feedback circuit includes means for initiating a lamp electrode heating cycle just prior to lamp start-up, said means for initiating capable of reinitiating said heating cycle if the lamp fails to start.

23. The ballast circuit of claim 20, wherein said feedback further comprises a second photoresistor remotely located from the lamp.

24. The ballast circuit of claim 20, wherein said feedback circuit further comprises an input jack for receiving computer generated control signals.

* * * * *